US005850178A

United States Patent [19]

Ha et al.

[11] Patent Number: 5,850,178

[45] Date of Patent: Dec. 15, 1998

[54] ALARM SYSTEM HAVING SYNCHRONIZING PULSE GENERATOR AND SYNCHRONIZING PULSE MISSING DETECTOR

[75] Inventors: Simon Ha, Aurora; Andy Chud, Geneva, both of Ill.

[73] Assignee: Pittway Corporation, Chicago, Ill.

[21] Appl. No.: 842,057

[22] Filed: Apr. 23, 1997

[51] Int. Cl.[6] ..... G08B 29/00

[52] U.S. Cl. ..... 340/512; 340/506; 327/18

[58] Field of Search ..... 340/505, 506, 340/507, 512, 523; 375/354, 357, 377; 327/18

[56] References Cited

U.S. PATENT DOCUMENTS 5,525,962 6/1996 Tice ..... 340/506

5,557,262 9/1996 Tice ..... 340/577

5,598,139 1/1997 Karim et al. ..... 340/286.11

*Primary Examiner*—Daniel J. Wu

*Attorney, Agent, or Firm*—Rockey, Milnamow & Katz, Ltd.

[57] ABSTRACT

A pulse detection circuit to be used in combination with a generator of a train of synchronizing pulses. The detection circuitry remains in a first, inactive state in the presence of an ongoing sequence of synchronization pulses. In the event of a detected absence of synchronizing pulses for a predetermined period of time, the detection circuitry changes state and generates an electrical output signal indicative of one or more missing synchronizing pulses. The detection circuitry can incorporate either digital or analog timing circuitry.

4 Claims, 3 Drawing Sheets

ALARM SYSTEM HAVING SYNCHRONIZING PULSE GENERATOR AND SYNCHRONIZING PULSE MISSING DETECTOR

FIELD OF THE INVENTION

The invention pertains to alarm indicating devices which are part of a fire detection system. More particularly, the invention pertains to circuitry for detecting the presence of a plurality of synchronization pulses for purposes of triggering visible alarm indicators, on a synchronized basis, and for providing supervisory signals indicating an absence of such synchronizing pulses.

BACKGROUND OF THE INVENTION

Building control systems often include fire detection systems. The fire detection systems usually incorporate a plurality of spaced apart ambient condition detectors, such as smoke detectors, fire detectors, thermal detectors, gas detectors, and the like, which are located in a region being supervised. Signals received from the various detectors are processed in a common control unit, or one of a plurality of control units, for the purposes of determining if the detected ambient conditions indicate the presence of an alarm condition such as a fire.

The alarm systems also include a plurality of spaced apart audible and visible alarm indicating output units. These units include triggerable visual strobe lights, as well as audible horns, sirens, or the like.

Systems are known for providing synchronizing signals to the strobe units. One such system is disclosed and claimed in U.S. Pat. No. 5,598,139, entitled Fire Detecting System With Synchronized Strobe Lights, which is assigned to the assignee hereof. That patent is incorporated herein by reference. Such systems, when an alarm condition has been detected, enable the audible and visual output devices and also initiate generation of the synchronized pulse train for use by the visual output devices. In the absence of synchronizing pulses, the visible indicators may not flash.

It would be desirable if the control unit were able to monitor the synchronizing pulse train for the purpose of detecting an absence of such synchronizing pulses and notifying the system operator of that absence. Additionally, it would be desirable to be able to incorporate such circuitry into the circuitry which is producing the synchronizing pulses without having to significantly increase the manufacturing complexity or the cost to manufacture such synchronizing modules.

SUMMARY OF THE INVENTION

Circuitry for detection of one or more missing pulses in a pulse train includes at least one pulse detector. Timing circuitry is coupled to the pulse detector.

The timing circuitry has at least an input port which is coupled to the pulse detector. A representation of each of the pulses in the synchronizing train which is detected is in turn coupled to the timing circuitry. The timing circuitry has at least an initial state and a timing state. Each of the pulse representations which is received at the timing circuitry forces the timing circuitry into the initial state. The timing circuitry then enters the timing state and is adapted to generate an electrical output which is indicative of the time that has elapsed since the arrival of the most recent pulse representation.

So long as the pulses from the synchronizing pulse train are continually being detected, the timing circuitry will be continually forced into its initial state. In the absence of a continuous stream of synchronizing pulses, the timing circuitry generates the output signal. The output signal, which indicates the amount of time that has passed since the last pulse has been detected, can in turn be used to trigger a solid state switch or other device.

A gate input to a solid state switch such as an SCR or unijunction transistor, without limitation, can be coupled to the output signal from the timing circuitry. In response to the timing circuitry indicating that a synchronizing pulse has not been detected for a predetermined period of time, the solid state switch element changes state and produces an output signal indicative of an absence of synchronization pulses. The output signal can be used, if desired, to close a relay, thereby providing feedback to a control unit.

In one aspect, the timing circuitry can be implemented digitally with a clock, for example, and a plurality of serially coupled counters. Alternately, a digital timer or timing circuit could be used. Finally, analog timing circuitry can be used.

In yet another aspect, an "and" gate can be coupled to a plurality of pulse sensors. The output of the and gate can be used to reset or enable the timing circuit.

The timing circuit can incorporate, for example, a resistor capacitor combination which is in turn coupled to a source of electrical energy. When enabled, the timing circuitry charges the capacitor thereby producing an electrical signal which can be coupled to the gate input of the solid state switch. In the event that the amplitude exceeds a predetermined value, the switch will go from a non-conducting to a conducting state.

Once the solid state switch changes state, it can in turn be used to close a relay, thereby providing a contact closure to be used as feedback for the control system. Both latching solid state switches and latching relays can be used for improved reliability.

Other features and advantages of the present invention will become readily apparent from the following detailed description, the accompanying drawings, and the appended claims.

DETAILED DESCRIPTION

Figure 1:
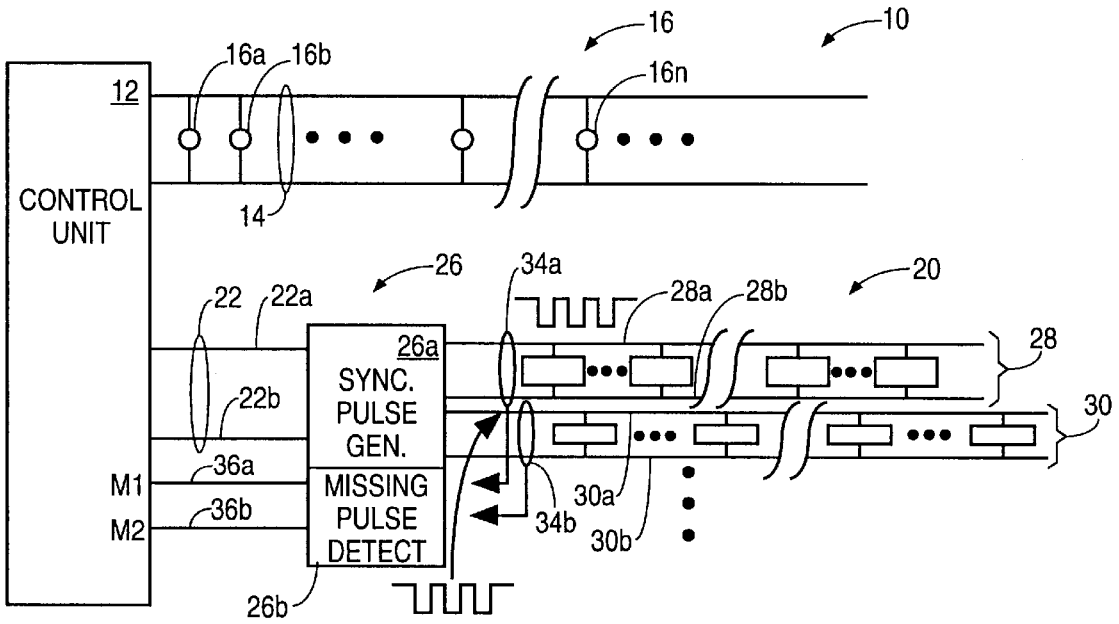
FIG. 1 is a block diagram of an alarm system including a synchronizing pulse generator and missing pulse detection circuitry.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

FIG. 1 illustrates an alarm system 10 which could, in fact, be part of a larger building control system or could be used in a stand alone fashion. The system 10 includes a control unit 12 which could incorporate a programmable processor, memory, and a set of control instructions. Coupled to the control unit 12, via interface circuitry, is a communication link 14.

The communication link 14 is coupled to a plurality of ambient condition detectors 16. The detectors 16 could include fire, gas, smoke, or thermal detectors without limitation. The members 16*a*, 16*b* . . . 16*n* of the plurality are spaced apart in a region being supervised.

In response to signals received from the detectors 16, the control unit assesses whether an alarm condition is being indicated in the vicinity of one or more of the detectors 16. In the event that an alarm condition appears to be present in the region being supervised, the control unit 12 can energize a plurality of visible and/or audible alarm output devices 20.

The output devices 20 are coupled to the control unit 12 by a plurality of output communication lines 22. Between the lines 22 and the plurality of output devices 20 is an output control module 26. The output control module 26 includes a synchronizing pulse generator 26*a* which could be of a type disclosed in the above-noted U.S. Pat. No. 5,598,139. The module 26 also includes missing pulse detection circuitry 26*b*.

In a quiescent, non-alarm state, the control unit 12 applies a voltage having a first plurality across the lines 22 as is conventional and well-known. In this state, the output devices 20 are inactive.

In the presence of an alarm condition, the polarity on the lines 22 is reversed, thereby providing electrical energy to activate the output devices 20. In this latter state, the synchronizing pulse generator 26*a* produces a synchronizing pulse train which is coupled to each of the output devices via loop 28, lines 28*a*, 28*b*, and loop 30, lines 30*a*, 30*b* as described in the above-noted U.S. Patent. While in FIG. 1 two sets of output lines 28*a*, 28*b*, and 30*a*, 30*b* are coupled to members of the plurality 20, it will be understood that the pulse generator 26*a* could be configured to drive only one output loop or a larger number of output loops if desired without departing from the spirit and scope of the present invention.

The missing pulse detection circuitry 26*b* is coupled to each of the output loops 28, 30 by pulse detectors 34*a*, 34*b*. In the configuration of the system 10 illustrated in FIG. 1, it is expected that the output loops 28 and 30 will be synchronized with a common synchronizing pulse train from the generator 26*a*. A failure of the pulse train to be detected on either the loop 28 or the loop 30 will be indicated by the missing pulse detection circuitry 28*b* via lines 36*a*, 36*b* which can be fed back to monitoring or supervisory ports M1, M2 of the unit 12.

Figure 2:
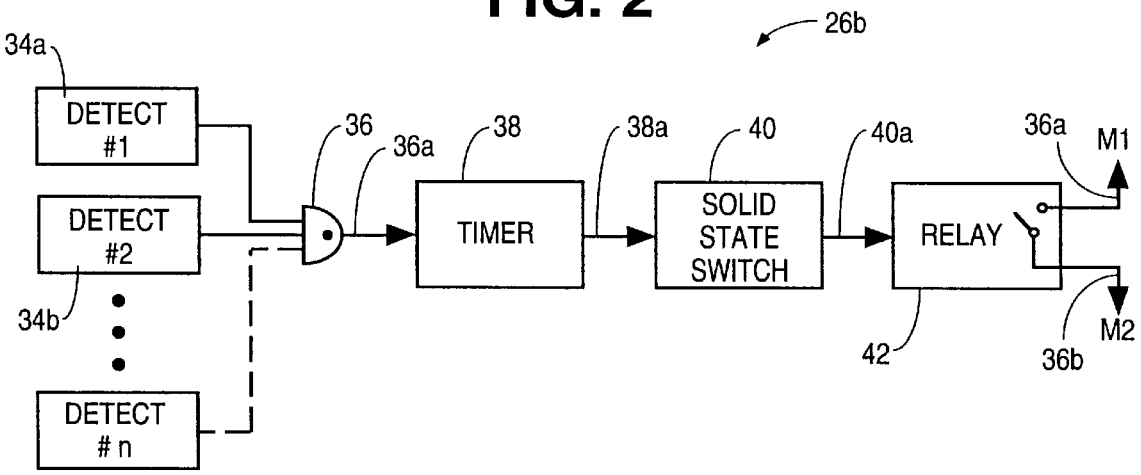
FIG. 2 is a block diagram of a missing pulse detection circuit of a type usable with the system of FIG. 1.

FIG. 2 illustrates a block diagram of the missing pulse detection circuitry 28*b*. This circuitry includes one or more pulse detectors, such as detectors 34*a*, 34*b*. . . 34*n*. It will be understood, of course, that the circuitry 26*b* could be used with a single output loop instead of multiple loops as illustrated in FIG. 1.

In the embodiment of the system 10 in FIG. 1, it is desired that the synchronizing output pulses be present on both of the output loops 28 and 30 simultaneously. Hence, the detectors 34*a*, 34*b* have output lines which are coupled to an "and" gate 36. A failure of the and gate 36 to detect two or more simultaneous pulses will be an indication that at least one of the output loops is not receiving synchronizing signals.

An output of the and gate 36 is coupled to an input of timer 38 via line 36*a*. Timer 38 which could be implemented in either digital or analog form without departing from the spirit and scope of the present invention is, for example, continuously reset by the presence of signals on the line 36*a* from the gate 36. As long as those signals appear with their expected repetition rate, for example, once a second for 20–50 milliseconds, timer 38 will remain in a first or a reset state.

In the event that the time interval between pulses on the line 36*a* exceeds a predetermined amount, for example, 5 or 6 seconds, the timer 38 will generate an output signal on a line 38*a*, indicative of the fact that two more pulses have not been detected simultaneously for the past 5 or 6 seconds. In this condition, the output on the line 38*a* causes solid state switch 40 to change state.

Preferably the switch 40 is a latching switch which will transition from a stable first state, an open circuit state, for example, to a stable second state, a closed circuit state, for example, in response to the signal from the timer on the line 38*a*. An output signal from switch 40 can, in turn, be used via a line 40*a* to energize relay 42 thereby short circuiting the lines 36*a*, 36*b* together.

In the event that one of the supervisory ports M1 or M2 has a current source on a potential source coupled thereto, the relay closure can be detected at the other port. The detected signal indicates the fact that one or more of the synchronizing pulse trains is not being properly applied to one or more of the output loops 28, 30.

Figure 3:
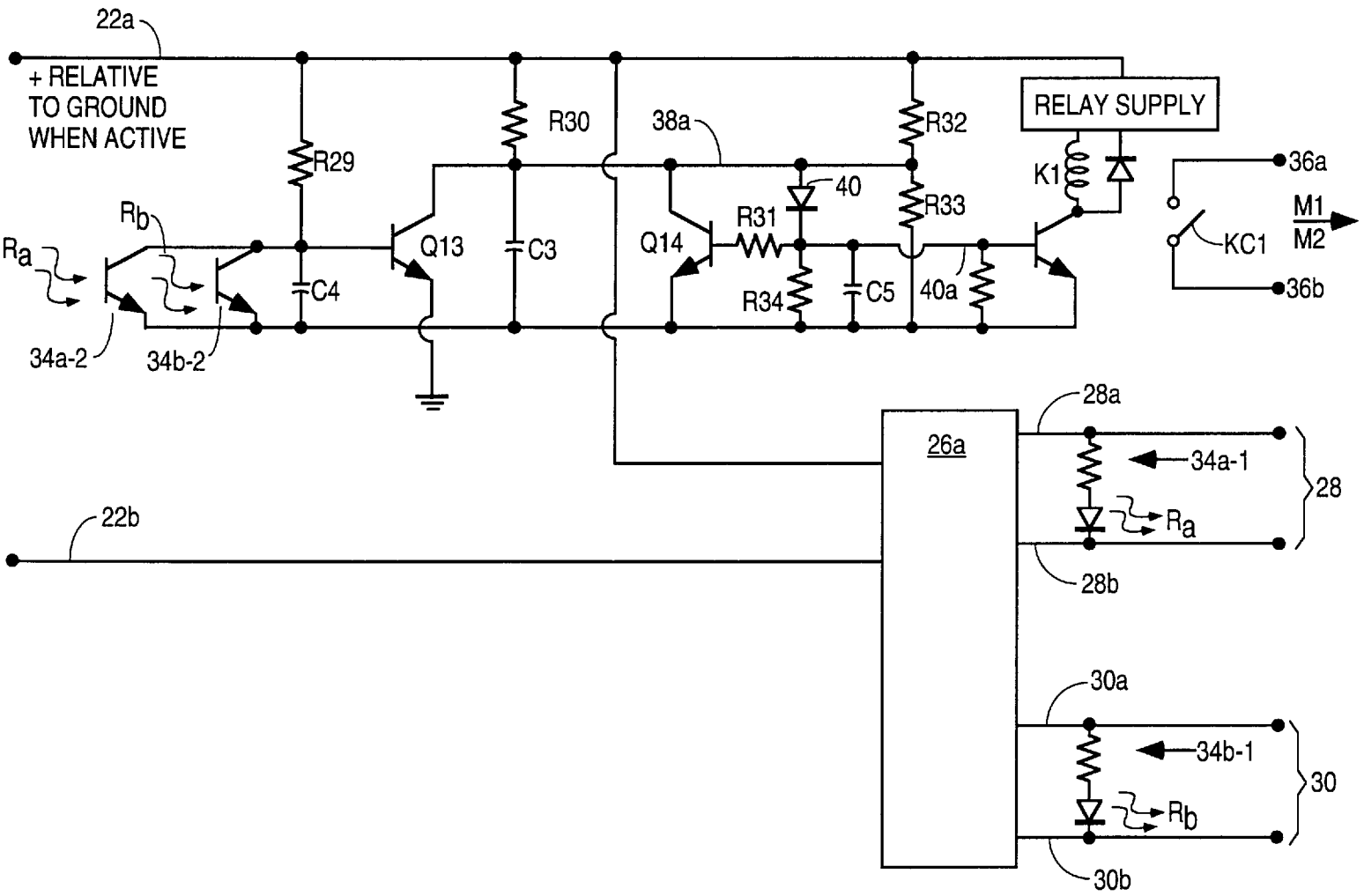
FIG. 3 is a schematic diagram of a preferred embodiment of a missing pulse detection system in accordance with FIG. 2.

FIG. 3 is a schematic of a preferred embodiment of an analog based missing pulse detection system 26*b*'. Pulse sensors 34*a*, 34*b* are implemented as optical isolators. The first part 34*a*-1, 34*b*-1 includes a resistor coupled to an input side of an optically isolated switch. The second part 34*a*-2, 34*b*-2 corresponds to the output side of the optically isolated switch.

When the control unit 12 detects an alarm condition and reverses the polarity of the signals on the lines 22, the corresponding photo diodes IC6 and IC7 start emitting energy which in turn causes the output sides 34*a*-2 and 34*b*-2 to conduct holding transistor Q13 off. This in turn permits resistor R30 of the timing circuit 38 to charge capacitor C3.

The increasing voltage across capacitor C3 is coupled as a gate input to a programmable unijunction transistor or SCR, the solid state switch 40. In response to the gate input voltage, the switch 40, if implemented as a programmable unijunction switch, will change state based on the threshold value established by the resistors R32, R33. When the solid state switch 40 changes state and conducts, voltage developed across resistor R34 which is in turn coupled to drive circuitry 42-1 energizes the relay 42. This in turn closes contacts 36*a*, 36*b*.

The timing circuitry 38 is reset by the synchronizing pulses going to ground simultaneously. This in turn turns off the output elements 34*a*-2, 34*b*-2. Capacitor C4 begins to charge in response to current from R29 which in turn causes Q13 to conduct. When Q13 conducts the voltage across capacitor C3 is discharged to the voltage between the emitter and collector of Q13 thereby resetting the timing circuit 38.

When the synchronizing pulses terminate and the polarities of the voltage on the loops 28 and 30 return to their normal values for an alarm condition output elements 34*a*-2 and 34*b*-2 will again conduct and again turn Q13 off. This in turn permits timer circuitry 38 to start cycling again.

In the event that the synchronizing pulses which are emitted with a period on the order of one second fail to simultaneously appear at the output sides of the optically coupled elements 34*a*-2, 34*b*-2, the input voltage to the semiconductor switch 40 will increase sufficiently that the switch will change state as discussed above. This change of state thereby generates a detectable supervisory signal indicating a loss of synchronization pulses.

Each time that the unijunction transistor 40 conducts transistor Q14 also conducts discharging timing capacitor C3. In the event that the unijunction transistor 40 does not latch into a conducting state, capacitor C3 will again be charged past the threshold voltage of the switch 40 thereby causing it to again conduct and latch into a conducting state.

The relay 42 can be implemented as a latching relay. This ensues once a loss of synchronization pulses has been detected, that it will be necessary to manually reset the relay 42 to remove the supervisory signal at the monitoring ports M1 or M2.

Figure 4:
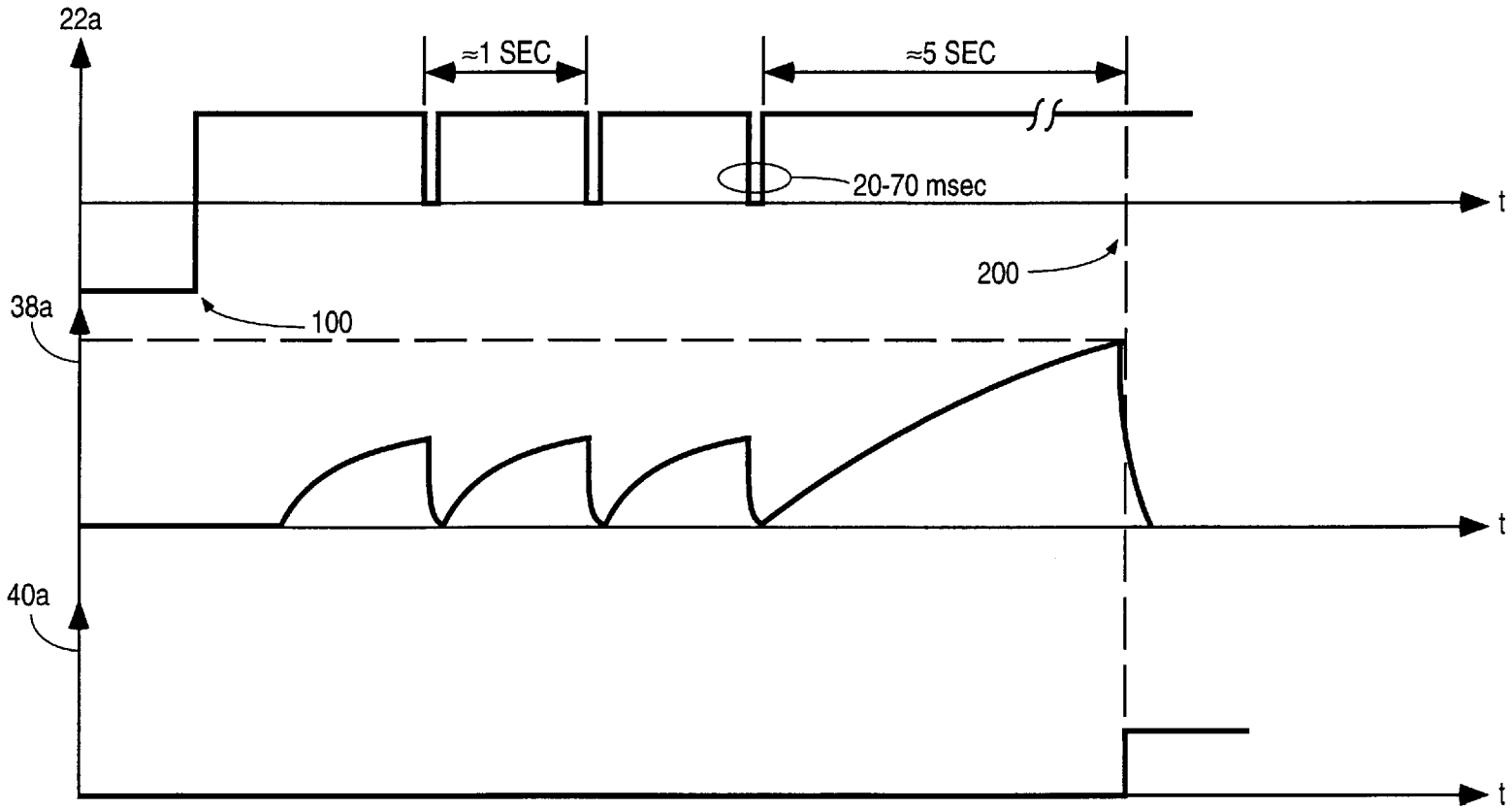
FIG. 4 illustrates a plurality of timing diagrams of different waveforms of the circuit of FIG. 3.

The graphs of FIG. 4 illustrate operation of the circuitry of FIG. 3. FIG. 4A illustrates switching the polarity of the voltage on the lines 22 in response to a detected alarm condition 100. Subsequent to an alarm condition being detected, the polarity on lines 22 is reversed and the pulse generator 26*a* generates synchronizing pulses with a one second period. FIG. 4B illustrates the charging waveform across the capacitor C3 in between synchronizing pulses. In the event that synchronizing pulses are lost, indicated generally at a time 200, the voltage on the capacitor C3 increases sufficiently to trigger solid state switch 40 thereby energizing relay 42.

Solid state switch 40 could be implemented using a Motorola programmable unijunction transistor type 2N6028. It will also be understood that the timer 38 could be implemented with a clock coupled to a plurality of series connected binary counters which in turn could be regularly reset by the appearance of the synchronizing pulses on the loops 28, 30. It will also be understood that other forms of analog and digital timing circuitry could be used without departing from the spirit and scope of the present invention.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. An alarm system comprising:

a control unit;

a plurality of ambient condition detectors coupled to the control unit;

a plurality of alarm indicating output devices;

a pulse generator coupled to the control unit and to the output devices wherein the generator, at least during an alarm condition, generates a train of synchronizing pulses for at least some of the output devices; and circuitry coupled to the control unit and to the output devices for detecting an absence of the synchronizing pulses and for coupling an electrical signal indicative thereof to the control unit.

2. A system as in claim 1 wherein at least some of the output devices generate visible alarm indicators only in response to the synchronizing pulses.

3. A system as in claim 2 wherein at least some of the output devices also include audible alarm output units.

4. An alarm system as in claim 1 wherein the circuitry for detecting includes a timer for generating an output signal indicative of the passage of a time interval corresponding to a plurality of spaced apart synchronization pulses.

* * * * *